United States Patent [19]

Leth

[11] Patent Number: 4,754,589

[45] Date of Patent: Jul. 5, 1988

[54] ROOFING PLATE, A PROOFING STRIP FOR A ROOFING PLATE, AND A METHOD OF PRODUCING A ROOFING PLATE

[75] Inventor: Verner Leth, Aalborg, Denmark

[73] Assignee: Dansk Eternit-Fabrik A/S, Aalborg, Denmark

[21] Appl. No.: 7,919

[22] Filed: Jan. 13, 1987

Related U.S. Application Data

[63] Continuation of Ser. No. 740,269, May 14, 1985, abandoned.

[30] Foreign Application Priority Data

Sep. 30, 1983 [DK] Denmark ..... 4542/83

[51] Int. Cl.[4] ..... E04D 1/04; E04D 1/16

[52] U.S. Cl. ..... 52/538; 52/533; 52/544; 49/475

[58] Field of Search ..... 52/539, 546, 551, 394, 52/533, 538, 536, 95, 534; 49/475

[56] References Cited

U.S. PATENT DOCUMENTS

| | | | |
|---|---|---|---|
| 491,625 | 2/1893 | Wutke | 52/538 |
| 719,514 | 2/1903 | Schall | 52/538 |
| 973,946 | 10/1910 | Lindau | 52/538 |
| 1,266,137 | 5/1918 | Melde . | |
| 2,002,244 | 5/1935 | Kremper | 52/538 X |
| 2,130,178 | 9/1938 | Elmendorf | 52/394 X |
| 3,660,955 | 5/1972 | Simon | 52/533 X |
| 4,148,953 | 4/1979 | Horton | 49/475 X |
| 4,164,599 | 8/1979 | Kessler | 49/475 X |
| 4,288,483 | 9/1981 | Miska et al. | 49/475 X |
| 4,372,014 | 2/1983 | Simpson | 52/536 |

FOREIGN PATENT DOCUMENTS

| | | | |
|---|---|---|---|
| 1158688 | 12/1963 | Denmark . | |
| 1243372 | 8/1968 | Denmark . | |
| 1005256 | 9/1957 | Fed. Rep. of Germany . | |
| 1125629 | 3/1962 | Fed. Rep. of Germany | 52/536 |
| 1759881 | 7/1971 | Fed. Rep. of Germany . | |
| 1759427 | 1/1972 | Fed. Rep. of Germany . | |
| 2264570 | 4/1974 | Fed. Rep. of Germany . | |
| 2616919 | 10/1977 | Fed. Rep. of Germany . | |
| 7539674 | 7/1976 | France . | |
| 48-45679 | 6/1973 | Japan . | |
| 76666 | 4/1950 | Norway . | |

*Primary Examiner*—David A. Scherbel
*Assistant Examiner*—Richard E. Chilcot, Jr.
*Attorney, Agent, or Firm*—Merchant, Gould, Smith, Edell, Welter & Schmidt

[57] ABSTRACT

A roofing plate (10), such as a corrugated, interlocking tile, is at its upper side surface provided with a proofing strip (27) arranged extending across the corrugations of the roofing plate at the upper edge thereof. The proofing strip (27) is constituted by a strip of upright synthetic fibres, such as a combination of polyamide fibres of a length of 3 mm and of a length of 5 mm and of thickness of 0.05 mm (22 dtex). The strip (27) is adapted to provide a barrier when its is clamped between the upper side surface of the roofing plate and the lower side surface of an adjacent roofing plate, and the barrier permits the passage of air from the inside of a loft defined below the roofing plates and out and form the outside and into the loft and further permits the passage of water from the inside of the loft and out, and blocks the passage of water and dust form the outside and into the loft. A further proofing strip (29) may be arranged along one of the edges of the roofing plate extending along the corrugations thereof. The proofing strip (27) may be provided as a single component adapted to be arranged on the upper or lower side surface of a roofing plate prior to the arrangement of the roofing plate overlapping another roofing plate on the roof and may comprise a base layer having a glue layer and a slip paper, if desired. The proofing strip (27) may be applied to the roofing plate (10) in an electrostatical application process (Flock application) and retained in a glue layer of the roofing plate. (FIG. 1).

18 Claims, 5 Drawing Sheets

Figure 1:
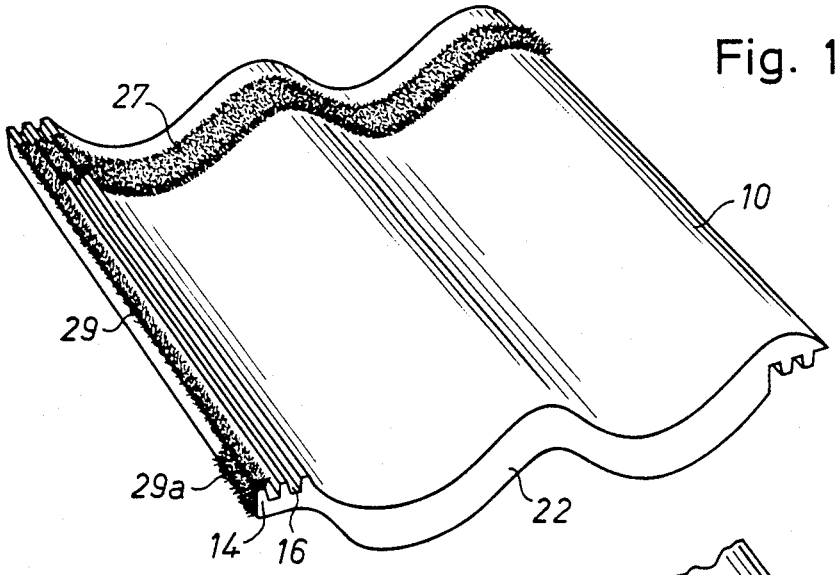

ROOFING PLATE, A PROOFING STRIP FOR A ROOFING PLATE, AND A METHOD OF PRODUCING A ROOFING PLATE

This is a continuation of application Ser. No. 740,269 filed May 14, 1985, which in turn was filed under the PCT under International Application No. PCT/DK84/00096 on Sept. 28, 1984 now abandoned.

The present invention relates to a roofing plate having opposite side surfaces and comprising at least one proofing strip arranged on at least one side surface of the roofing plate and extending thereacross.

It is generally known to mount roofing plates, e.g. plates of metal, plastics, slate, fibrous cement or a similar material or tiles, particularly tiles made from concrete, clay or fibrous cement, on a roof construction made from rafters, especially wood rafters, the roofing plates being arranged in an overlapping relationship in such a way that one roofing plate overlaps an adjacent roofing plate. Normally, the roof construction on which the roofing plates are mounted, has a pitch so that the roofing plates are arranged in such a way that one roofing plate overlaps a lower roofing plate. By this pitch snow and water do not collect on the upper surface of the roofing plates, but run down the sloping roof surfaces of the roof construction owing to the effect of gravity.

Hitherto, in connection with tiled roofs, i.e., roofs made from tiles of concrete, clay or fibrous cement, the transitions between the individual roofing plates of the roof have most often been proofed by pointing, e.g. by putty or filler material, particularly a foamed filler material, e.g. polyurethane foam, being mounted in the gaps between the roofing plates from the inside of the loft under the roof. It is further known to use proofing strips for proofing the gaps between the individual roofing plates of the roof, as well as to mount a so-called roofing underlay, e.g. of cardboard or plastics material, under the roof rafters to produce a substantially hermetic seal of the loft in relation to the environment.

These known roof proofing methods, however, suffer from a number of disadvantages. Thus, pointing of a tiled roof is both a difficult and a timeconsuming operation, and particularly when foamed filler material, e.g. polyurethane foam, is used, the connection between the individual roofing plates of the roof tends to give leaks after a fairly short time, primarily due to the influence of frost and thaw. It has also proved difficult to establish a weatherproof connection with long term stability between roofing plates by the use of known proofing strips.

A disadvantage of the roof proofing methods of the known art is, however, that the provision of a hermetic sealing of the roof in relation to the environment causes formation of condensed water in the loft under the roof, and the formation of condensed water involves a risk of rot or dry rot occurring in the wood construction of the roof. The reason for the occurrence of this problem is first of all the hermetic sealing of the roof in relation to the environment, but the problem has obviously become more pronounced in later years, after the houses have become better insulated. Previously, heat leaks to the loft caused a suction effect providing ventilation away of the humid air before it condensed on the bottom surface of the roofing plates of the roof. Although, to obtain a certain venting of the loft, venting ducts, particularly in the form of venting roofing plates, have been provided in connection with the known roof constructions, but it has turned out that these venting ducts have not been able to compensate sufficiently for the increased risk of formation of condensed water as a result of the more efficient thermal insulation, and at the same time been able to provide the required proofing of the inside of the roof against rain, snow and dust from the outside.

It is thus an object of the present invention to provide a roofing plate of the above type which renders possible a labour-saving mounting of roofing plates on a roof as well as eliminates the above disadvantages with regard to the formation of condensed water and any consequent rot or dry rot attacks on the wood construction of the roof.

This object is fulfilled by means of a roofing plate according to the invention and comprising at least one proofing strip arranged on at least one of the side surfaces of the plate and extending thereacross, the plate being adapted to be arranged on a roof partly overlapping an adjacent roofing plate and partly being overlapped by another adjacent roofing plate, the roof defining a loft thereunder, the strip being adapted to provide a barrier when it is clamped between said side surface of the plate and the opposite side surface of said adjacent roofing plate, and the barrier permitting the passage of air from the inside of the loft and out and from the outside and into the loft and further permitting the passage of water from the inside of the loft and out and blocking the passage of water and dust from the outside and into the loft.

Thus, the roofing plate according to the invention to a great extent eliminates the use of separate venting ducts which, as mentioned above, have proved not to be sufficiently efficient, and at the same time eliminates the risk of rot or dry rot attacks on the wood construction of the roof as a result of the barrier forming effect of the proofing strip, which on one side provides the required venting of the loft and on the other side prevents the ingress of water in the form of rain as well as snow, and dust from the outside. The mounting of the roofing plate of the invention on a roof further eliminates the necessity of establishing a roofing underlay or of subsequent pointing such as has hitherto been necessary particularly in connection with tiled roofs.

In a preferred embodiment of the invention, the proofing strip is constituted by a strip of upright synthetic fibres, e.g. fibres of plastics, polyamides, polyester, etc. The synthetic fibres permit displacement of the roofing plates in relation to each other as a result of thermal expansion of the roofing plates and of the underlying wood construction, and simultaneously form the barrier characteristic for the invention.

Dependent on the material of the roofing plate and of the free distance between the roofing plates when they are mounted on a roof, the synthetic fibres may have a free length of about 1–30 mm, preferably about 2–15 mm, more preferably about 3–8 mm. Dependent on the fibre length the synthetic fibres may have a thickness of about 0.01–0.5 mm, preferably about 0.05 mm. Normally, the characteristics of the synthetic fibres are specified in units of dtex, i.e. the weight in grams of a predetermined length, e.g. 10.000 m, of the fibre is specified. Obviously the fibre thickness and the fibre length must be adapted to each other in such a way that the resulting synthetic fibre has sufficient mechanical strength to provide a mechanically stable proofing strip. To increase the barrier forming effect of the proofing strip, the synthetic fibres thereof may form a maze pattern. Alternatively, the proofing strip may be composed of fibres of different lengths and/or of different thicknesses.

In another embodiment of the roofing plate according to the invention the proofing strip is constituted by knobs which are of a hydrophobic material and which form a maze pattern. Due to their hydrophobic material, the knobs permit free passage of water, but the maze pattern of the knobs blocks the passage of water and dust from the outside into the loft.

In this embodiment of the roofing plate of the invention the knobs may be made of any hydrophobic material able to withstand the mechanical loads due primarly to thermal influences, from the roofing plates of the roof, but in accordance with one embodiment of the roofing plate of the invention the knobs are latex knobs impregnated with silicone.

The knobs which are made of a hydrophobic material and form a maze pattern, must of course, like the above synthetic fibres, have a free height which corresponds substantially to the free distance between the roofing plates when they are mounted on a roof. In accordance with the invention the knobs may have a free height of about 1–30 mm, preferably about 3–15 mm, more prefereably about 3–8 mm, thus satisfying the requirement both to the mechanical strength and to the barrier effect characteristic for the invention.

Conventionally, the roofing plate is of a substantially rectangular configuration having pairs of opposite edges constituting vertical and horizontal edges of the plate when the plate is arranged on the roof. In order to provide proofing of the loft in relation to the environment in accordance with the principles of the present invention, the proofing strip may extend along one of the horizontal edges of the plate.

In a first embodiment of the roofing plate of a substantially rectangular configuration and provided with the proofing strip extending along one of the horizontal edges of the plate, the proofing strip is arranged on the side surface of the plate constituting the upper side surface when the plate is arranged on the roof. Alternatively, the proofing strip may be arranged on the side surface of the plate constituting the lower side surface when the plate is arranged on the roof.

Whereas the above described proofing strip extending along one of the horizontal edges of the plate provides proofing between a roofing plate and another roofing plate arranged below or above the first mentioned roofing plate in the above described overlapping relationship, a further proofing strip arranged extending along one of the said vertical edges of the plate of a substantially rectangular configuration may further provide proofing between any two roofing plates arranged horizontally beside each other on the roof. Although the further proofing strip may be arranged on the upper side surface or, alternatively, on the lower side surface of the roofing plate fulfilling the proofing requirements in accordance with the teaching of the present invention, it is, however, from a productional point of view, preferred to provide the proofing strip extending along said horizontal edge of the plate and the further proofing strip extending along one of said vertical edges of the plate on the same upper or, alternatively, lower side surface of the plate, as the proofing strips may be arranged on the roofing plate without providing access to more than one of the side surfaces of the roofing plate, e.g. without turning the roofing plate upside down.

In an alternative embodiment of the roofing plate of a substantially rectangular configuration, a first proofing strip may be arranged on said upper side surface of the plate at the uppermost horizontal edge thereof, and the second proofing strip may be arranged on said lower side surface of the plate at the lowermost horizontal edge thereof. Although this embodiment of the invention provides proofing in accordance with the teaching of the present invention, it suffers from the above described productional drawback, viz. that proofing strips have to be arranged on opposite side surfaces of the roofing plate comprising a number of production steps involving the provision of access from both side surfaces or turning the roofing plate upside down.

A further object of the present invention is to provide a proofing strip for use in connection with a roofing plate having opposite side surfaces and being adapted to be arranged on a roof partly overlapping an adjacent roofing plate and partly being overlapped by another adjacent roofing plate, which renders possible a labour-saving mounting of roofing plates on a roof and eliminates the above described disadvantages with regard to the formation of condensed water and any consequent rot and dry rot attack on the wood construction of the roof.

This further object is fulfilled by means of a proofing strip according to the invention, comprising a base layer and being adapted to provide a barrier when it is clamped between opposite side surfaces of adjacent roofing plates, the barrier permitting the passage of air from the inside of the loft and out and from the outside and into the loft and further permitting the passage of water from the inside of the loft and out and blocking the passage of water and dust from the outside and into the loft. The proofing strip according to the invention may be placed on the upper side surface of a roofing plate and thus be clamped between this upper surface and the lower side surface of an adjacent roofing plate, or on the lower side surface of a roofing plate and thus be clamped between this lower side surface and the upper side surface of an adjacent roofing plate. Alternatively, a first proofing strip according to the invention and a second proofing strip according to the invention may be arranged on the upper side surface of the first roofing plate and on the lower side surface of a second roofing plate, respectively, in order to provide a dual-side proofing or burr-like proofing.

The proofing strip according to the invention may be shaped in accordance with any of the principles of the above embodiments of the roofing plate according to the invention and further combined therewith, and may thus be constituted by a strip of synthetic fibres extending upright from the base layer, or by knobs placed on the base layer and beng of a hydrophobic material and forming a maze pattern.

The invention further relates to methods of producing a roofing plate according to the present invention.

In accordance with a first aspect of the method of producing a roofing plate according to the present invention, the roofing plate is cast in a mould, and the proofing strip, being of any of the above embodiments, is arranged in a groove in the mould or form before the latter is filled for casting the roofing plate. Thus a simple, but secure fastening of the proofing strip to the roofing plate is obtained by a method which requires a minimum of extra operations in relation to the roofing plate casting process itself.

In accordance with another aspect of the method of producing a roofing plate according to the present invention having a proofing strip formed by a strip of upright synthetic fibres, the synthetic fibres are transferred to an adhesive layer on the roofing plate and are retained on the roofing plate in the adhesive layer which is then cured.

When this method according to the invention is employed, the synthetic fibres may be transferred to the roofing plate in a simple mechanical way, e.g., by so-called vibration application. In accordance with a particular embodiment of the method according to the invention, the synthetic fibres are transferred to the adhesive layer in an electrostatically charged state of a high potential, and the adhesive layer is maintained at a polarity opposite to the polarity of the fibres. The electrostatic charging of the fibres causes them to repel each other electrostatically, and consequently the fibres will arrange themselves standing substantially upright from the adhesive layer of the roofing plate.

In accordance with this aspect of the method of the present invention, the adhesive layer may be a layer of glue. Consequently, the proofing strip formed by synthetic fibres may be provided on a roofing plate which is precast or prefabricated, the synthetic fibres being glued to the roofing plate by means of a layer of glue applied thereto. This method may be carried out on a building site, if desired, so that prior to the mounting of the roofing plates on a roof, the roofing plates have a layer of glue applied and then a synthetic fibre proofing strip is applied electrostatically, whereafter the layer of glue is cured.

In accordance with a special embodiment of the method of the invention, the roofing plate is of a curable material, and the synthetic fibres are transferred to the roofing plate before the latter is cured, and are retained in a surface layer of the roofing plate, said layer constituting the adhesive layer. In accordance with this embodiment, the synthetic fibres constituting the proofing strips according to the invention are cast into the material of the roofing plate itself, providing a particularly simple method of production.

The invention will now be further described with reference to the drawing, wherein FIG. 1 is a perspective view of a first, presently preferred embodiment of a roofing plate according to the invention having proofing strips according to the invention arranged on the upper side surface of the roofing plate, FIG. 2 a vertical sectional view through the first embodiment of the roofing plate according to the invention shown in FIG. 1 arranged on a corresponding roofing plate mounted on a supporting wood rafter, FIG. 3 a perspective view corresponding to FIG. 1 of a second embodiment of a roofing plate according to the invention having proofing strips according to the invention arranged on the lower side surface of the roofing plate, FIG. 4 a vertical, sectional view corresponding to FIG. 2 through the second embodiment of the roofing plate according to the invention shown in FIG. 3 arranged on a corresponding roofing plate mounted on a supporting wood rafter, FIG. 5 a vertical sectional view through a slightly modified embodiment of the first embodiment of the roofing plate shown in FIG. 1 arranged on a corresponding roofing plate mounted on a supporting wood rafter, FIGS. 6, 7, 8 and 9 perspective views of a third, a fourth, a fifth and a sixth embodiment, respectively, of a roofing plate according to the invention having a proofing strip according to the invention arranged on the upper side surface of the roofing plate, FIGS. 10 and 11 vertical, sectional views corresponding to FIGS. 2, 4 and 5 of alternative embodiments of the second embodiment of the roofing plate shown in FIGS. 3 and 4, FIG. 12 a sectional view at right angles to the vertical sectional view of FIG. 2, FIG. 13 a sectional view corresponding to FIG. 12 through the second embodiment of the roofing plate shown in FIGS. 3 and 4, FIG. 14, a sectional view corresponding to FIGS. 12 and 13 through the fifth embodiment of the roofing plate according to the invention shown in FIG. 8, FIGS. 15 and 16 schematical views illustrating production plants for carrying out methods of producing roofing plates according to the invention in accordance with the teaching of the present invention, FIG. 17 a schematical top view of a production plant presently constituting the preferred embodiment for carrying out the presently preferred embodiment of the method of producing roofing plates according to the invention, and FIG. 18 a diagram illustrating proofing characteristics of a conventional roofing plate and of the roofing plate according to the invention shown in FIGS. 1 and 2.

In FIGS. 1, 2, 3, 4 and 5, a roofing plate 10 is shown which is a corrugated tile made from concrete, clay or fibrous cement. In FIG. 1, a first side surface is shown, viz. the side surface facing outwards from a roof, whereas in FIG. 3, the second side surface is shown, viz. the side surface facing towards a loft defined within or below the roof. It is to be understood that the terms indicating directions, such as upper, lower, vertical, horizontal, etc. used in the present context, refer to the conventional orientation of the roofing plates or tiles when mounted on a roof supporting wood construction of a predetermined pitch. As is evident from FIG. 3, the corrugated roofing plate or tile 10 is provided with a bead 12 at its lower side surface and at its uppermost edge extending transversely across the corrugations. As is evident from FIGS. 2, 4 and 5 the bead 12 is adapted to catch behind a supporting wood rafter 34, when the roofing plate or tile 10 is mounted on a bearing wood construction. At its lower side surface, and at the lowermost edge thereof, and opposite to the bead 12, the roofing plate 10 has three beads 18, 20 and 22 extending substantially across the corrugations and further two grooves 24 and 26 defined between said three beads and also extending substantially across the corrugations. The roofing plate or tile 10 is a so-called interlocking tile, i.e. it is provided with projections 14 and grooves 16 extending at the vertical outer edges of the tile along the corrugations thereof which are adapted to cooperate with corresponding grooves and projections, respectively, of an adjacent roofing plate or tile.

In the first, presently preferred embodiment of the roofing plate or tile according to the invention shown in FIG. 1, a first proofing strip 27 constituting a proofing strip according to the invention is arranged on the upper side surface of the roofing plate or tile at the uppermost edge thereof and extending across the corrugations of the plate or tile. On top of the outermost bead 14 shown in the left hand side of FIG. 1, a second proofing strip 29 constituting a further proofing strip according to the invention is arranged and is provided with a proofing strip extension 29*a* which is arranged at the vertical side surface of the roofing plate or tile at the lowermost edge thereof. The proofing strip extension 29*a* is adapted to cooperate with one or more of the left hand ends of the beads 18, 20 and 22, shown in FIG. 3. The proofing strips 27 and 29 and the proofing strip extension 29*a* are constituted by synthetic fibres, e.g. plastics or nylon fibres, preferably of a thickness of about 0.05 mm (22 dtex) and of a free length of about 3–8 mm. In the preferred embodiment, the synthetic fibre proofing strips 27, 29 and the synthetic fibre proofing strip extension 29*a* are made from a composition of synthetic fibres of a length of 3 mm and of a length of 5 mm. The proofing strips 27 and 29 and the proofing strip extension 29*a* exhibit the unique characteristic that they permit air to pass from the inside of the loft and out and from the outside and into the loft and further permit water to pass from the inside of the loft, but block the passage of water and dust from the outside and into the loft. Instead of the single proofing strip 29 arranged on top of the outermost bead 14, a proofing strip of basically identical construction may, alternatively or further, be arranged on the central or the innermost bead extending along the corrugations of the roofing plate or tile or in any of the grooves 16 defined between the beads 14.

Figure 2:
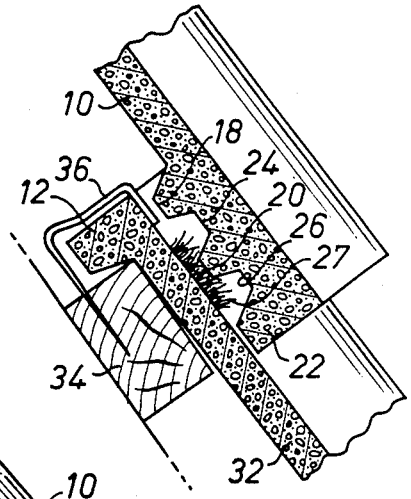

In FIG. 2 the roofing plate or tile 10 shown in FIG. 1 is mounted above and overlapping another roofing plate 32 which is completely identical to the roofing plate 10 and which is arranged in the above described manner having its bead 12 catching behind the roof rafter 34. Furthermore, the roof plate 32 is fastened to the rafter 34 by means of a roof hook 36. As is evident from FIG. 2, the proofing strip 27 is clamped between the lower side surface of the roofing plate or tile 10 and the upper side surface of the roofing plate or tile 32 providing the above described venting and blocking characteristics and further providing an optimum venting of the loft below the roof, which further eliminates the risk of rot or dry rot attacks on the wood construction of the roof (the roof rafter 34) caused by the formation of condensed water in the loft.

Figure 3:
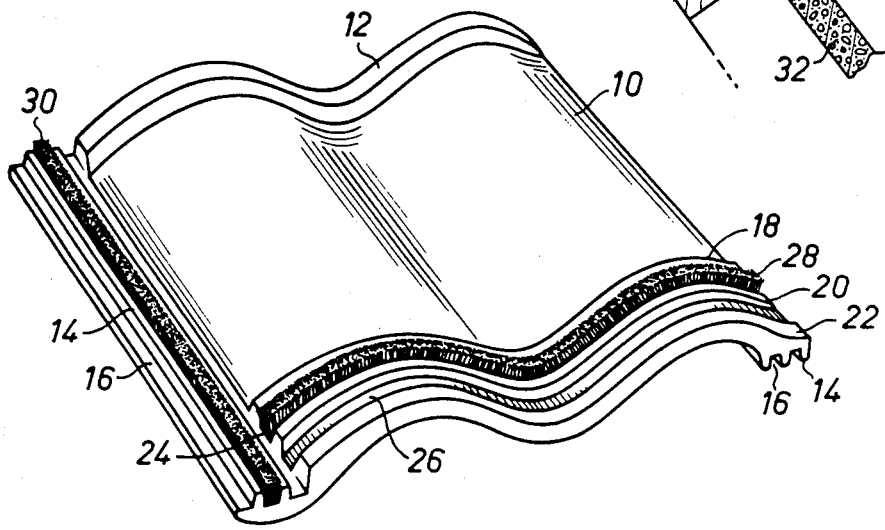

In FIG. 3 a second embodiment of a roofing plate according to the invention is shown. This second embodiment differs from the above described first, presently preferred embodiment of the roofing plate according to the invention in that the proofing strips 27 and 29 and the proofing strip extension 29*a* are omitted. Instead a proofing strip 28 is arranged on the lower side surface of the roofing plate or tile 10 in the groove 24 extending transversely across the corrugations of the roofing plate or tile, and a proofing strip 30 is further arranged at the lower side surface of the roofing plate or tile 10 in the central groove 16 extending along the corrugations of the roofing plate or tile. Obviously, instead of a single proofing strip 28 arranged in the groove 24, another or a further proofing strip may be arranged in the groove 26 (not shown on the drawing), and alternatively or supplementary, one or more proofing strips may be arranged on one or more of the beads 18, 20 and 22 extending across the corrugations of the roofing plate or tile. Furthermore, instead of the single proofing strip 30 arranged in the central groove 16, a further or alternative proofing strips may be arranged in the left-hand and the right-hand grooves 16 and on one or more of the beads 14 in the left-hand side lock of the roofing plate or tile 10.

Figure 4:
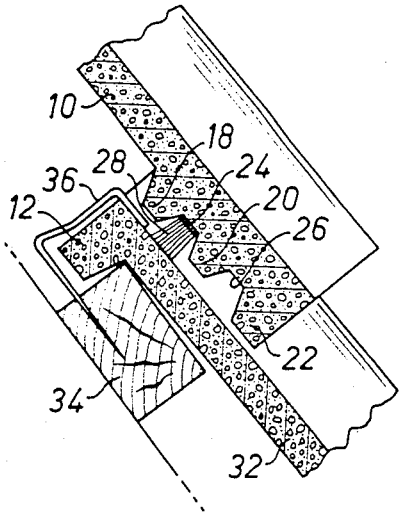

In FIG. 4, which basically corresponds to FIG. 2, the second embodiment of the roofing plate according to the invention shown in FIG. 3 is shown mounted above and overlapping the above described roofing plate 32 which is completely identical to the roofing plate 10 shown in FIG. 3. As is evident from FIG. 4, the proofing strip 28 is clamped between the lower side surface of the roofing plate or tile, viz. the groove 24, and the upper side surface of the roofing plate or tile 32 providing the above described barrier characteristics.

In the above described first and second embodiments of the roofing plate according to the invention, the proofing strips, i.e. the proofing strips 27 and 29 and further the proofing strip extension 29*a*, and the proofing strips 28 and 30 are of a basically idential configuration. However, the proofing strips may obviously be of a different configuration, i.e. have synthetic fibres of different thickness, length or different compositions of fibres, and furthermore, the proofing strips extending along the corrugations of the roofing plate or tile 10 may alternatively be constituted by a proofing strip of a different type and/or of a different materiale, e.g. an elastic and completely humidity-impermeable proofing material, such as a massive latex strip impregnated with silicone.

Figure 5:
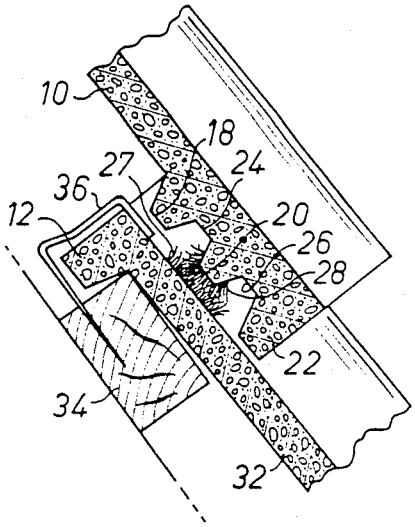
Figure 6:
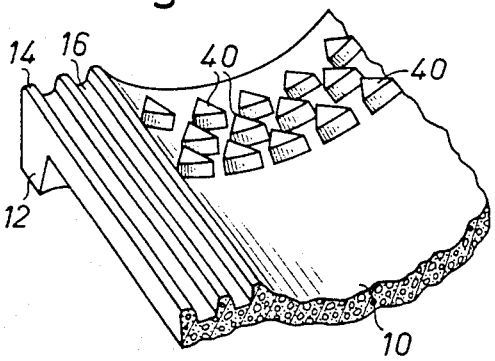
Figure 7:
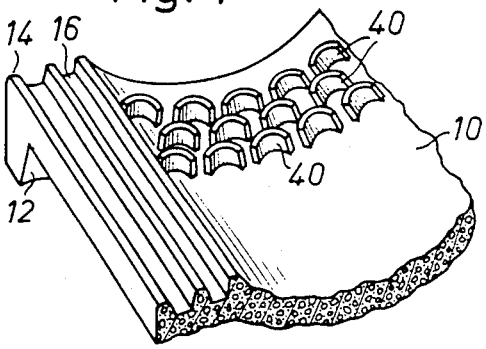

In FIG. 5 an alternative or combined embodiment of the above described first and second embodiments of the roofing plate according to the invention is shown. In this combined embodiment, the roofing plates or tiles 10 and 32 are each provided with a total of four proofing strips, viz. the above described proofing strips 27–30 which cooperate in pairs so that the proofing strips extending across the corrugations of the roofing plates or tiles, i.e. the proofing strips 27 and 28, cooperate, and so that the proofing strips extending along the corrugations of the roofing plates or tiles, i.e. the proofing strips 29 and 30, or the above mentioned proofing strips in cooperating grooves and beads of the interlock, cooperate with each other. These cooperating proofing strips may provide a burr-like locking.

In FIGS. 6, 7, 8 and 9 a third, fourth, fifth and sixth embodiment, respectively, of the roofing plate according to the invention is shown. In the embodiments shown in FIGS. 6–9, the proofing strip is constituted by knob-shaped bodies 40 which are made from a hydrophobic material, preferably latex impregnated with silcone, and which form a maze pattern and thus produce the barrier which, in accordance with the teaching of the invention, permits the passage of air and water from the inside of the loft and out and permits the passage of air from the outside and into the loft, but blocks the passage of water and dust from the outside and into the loft. The proofing strip constituted by knob-shaped bodies 40 is arranged on the upper side surface of the roofing plate or tile 10 opposite to the bead 12. However, the proofing strip constituted by the knob-shaped bodies 40 may alternatively be arranged at the lower side surface of the roofing plate or tile, and a proofing strip, e.g. of a different type and/or of a different material, such as an elastic and completely humidity-impermeable proofing strip of the above described type may further be arranged in one or more of the grooves 16 or on one or more of the beads 14. Like the embodiment shown in FIG. 5 in which the synthetic fibres constituting the proofing strips 27–30, preferably have a free length of 1–30 mm, preferably about 3–8 mm, the knobs 40 in the embodiments shown in FIGS. 6–9 have a corresponding length, i.e. a free length of about 1–30 mm, preferably about 3–8 mm.

Figure 10:
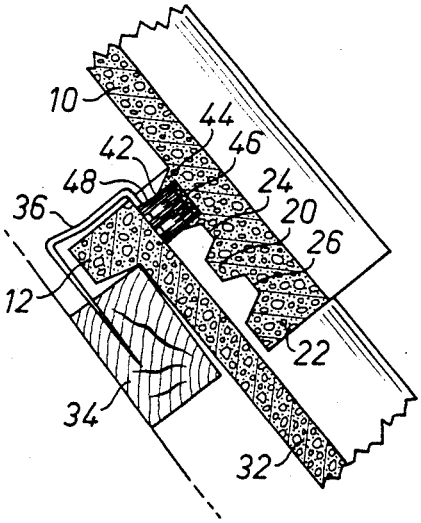
Figure 11:
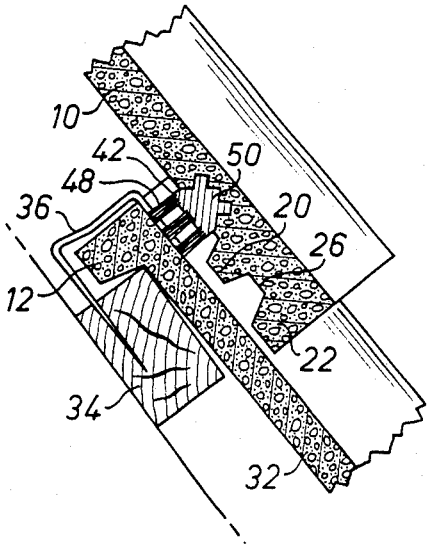

In FIGS. 10 and 11 vertical sectional views basically corresponding to the vertical sectional views of FIGS. 2, 4 and 5 are shown illustrating a seventh and eighth embodiment of the roofing plate according to the invention. In the embodiment shown in FIG. 10, the proofing strip 28 shown in FIG. 4 has been replaced by a proofing strip 42 which is cast into the roofing plate 10 in a bead 44 which is broader compared to the bead 18. The proofing strip 42, which is produced as a separate unit and then cast into the roofing plate as will be explained below, comprises a base layer 46, e.g. a plastic foil base layer or a gauze strip base layer from which the barrier forming part 48 of the proofing strip 42 protrudes. In the embodiment shown in FIG. 10, the barrier forming part 48 of the proofing strip 42 constitutes a combination of the above embodiments, as this barrier forming part 48 is constituted by upright synthetic fibres like the proofing strips 27–30 of the first and second embodiments of the roofing plate shown in FIGS. 1–5, but the synthetic fibres in the barrier forming part 48 form a maze pattern like the knob-shaped bodies 40 in the third, fourth, fifth and sixth embodiments shown in FIGS. 6–9.

A slightly modified eighth embodiment is shown in FIG. 11, in which the proofing strip 42, instead of a gauze strip base layer, has a base body 50 on which the synthetic fibres which form the barrier forming part of the proofing strip, are arranged prior to the casting of the base body 50 into the roofing plate 10.

The embodiments shown in FIGS. 10 and 11 may be modified by replacing the synthetic fibres of the barrier forming part 48 of the proofing strip 42 with latex knobs basically corresponding to the knob-shaped bodies 40 shown in FIGS. 6–9 impregnated with silicone and forming a maze pattern.

Figure 12:
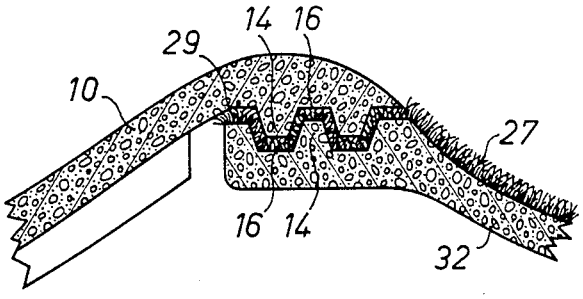

In FIG. 12 a horizontal sectional view through the above described first, presently preferred embodiment of the roofing plate according to the invention cooperating with the adjacent roofing plate is shown, i.e. a sectional view perpendicular to the sectional view of FIG. 2. In FIG. 12, the above described dual length proofing strips 27 and 29 are shown providing the proofing and barrier characteristics in accordance with the teaching of the present invention.

Figure 13:
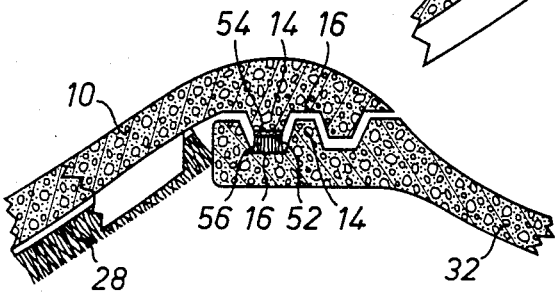
Figure 14:
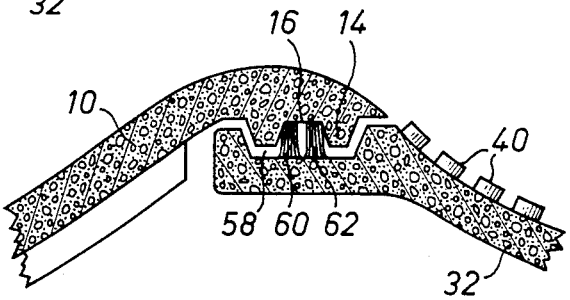

In FIGS. 13 and 14, horizontal sectional views basically corresponding to the above described sectional view of FIG. 12 are shown. In FIG. 13 an embodiment of the roofing plate according to the invention is shown basically of the construction shown in FIGS. 3 and 4. However, the proofing strip 30 extending along the corrugations of the roofing plate or tile and arranged in the central groove 16 is omitted. Instead, the innermost of the projections 14 of the roofing plate 10 is provided with a proofing strip 52 constituting a separate unit which is arranged on the roofing plate 10 prior to the arrangement of the roofing plate in the above described overlapping relationship with the adjacent roofing plate 32. The proofing strip 52 has a base layer 54, which is preferably a plastic foil or a gauze strip, and a proofing strip forming part 56. As is evident from FIG. 13, the part 56 may be constituted by synthetic fibres or instead by a hydrophobic elastic mass.

Preferably, the base layer 54 has a layer of glue protected by a slip paper which is removed before the proofing strip is arranged on the roofing plate 10, and apart from the base layer 54 shown in FIG. 13, the proofing strip 52 may be provided with a further base layer arranged opposite to the base layer 54 and adapted to adhere to the roofing plate 32 within the groove 16.

As, in the embodiment shown in FIG. 13, the proofing strip 30 shown in FIG. 3 has been replaced by a separate proofing strip 52 to be arranged on the roofing plate 10 prior to the arrangement of the roofing plate 10 in the overlapping relationship with the roofing plate 32, the proofing strip 28 shown in FIGS. 3, 4 and 5 may be replaced by a separate proofing strip which is also arranged on one of the projections 18, 20 and 22 or in one of the grooves 24 or 26 prior to the arrangement of the roofing plate 10 in the overlapping relationship with the roofing plate 32.

This separate proofing strip in replacement of the proofing strip 28 shown in FIGS. 3, 4 and 5 may also on both sides have a base layer and a glue layer, preferably protected by removable or tearable slip paper or slip papers to be removed as explained above prior to the arrangement of the strips on the roofing plate or tile, for making the proofing strip adhere to the lower side surface of the roofing plate or tile 10 and to the upper side surface of the roofing plate or tile 32.

Apart from synthetic fibres for forming the barrier in accordance with the teaching of the present invention, this separate proofing strip may have knobs of a hydrophobic material corresponding to the knobs shown in FIGS. 6–9 and arranged in a maze pattern. Such a separate proofing strip having maze pattern forming knobs may, like the above described separate proofing strip having synthetic fibres, have a single and two base layers with associated glue layers for adhering to the lower side surface of the roofing plate or tile 10 and to the upper side surface of the roofing plate or tile 32, respectively.

Figure 8:
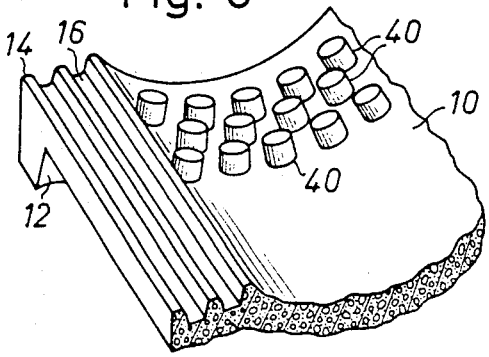
Figure 9:
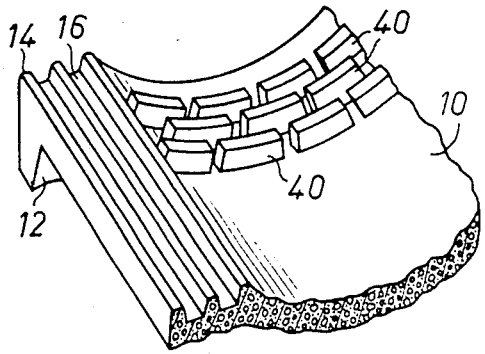

In FIG. 14 a sectional view basically corresponding to the sectional view shown in FIG. 13 is shown through an embodiment slightly modified in relation to the fifth embodiment of the roofing plate according to the invention shown in FIG. 8. In FIG. 14 the roofing plate 32 thus, instead of two grooves 16, has a single broader groove 58 in which two proofing strips 60 and 62 are arranged. The proofing strips 60 and 62 may be constructed in accordance with the teaching of the present invention, e.g. be of any of the above described types, i.e. they may be constituted by upright synthetic fibres or be made from an elastic, hydrophobic material forming a maze pattern.

Figure 15:
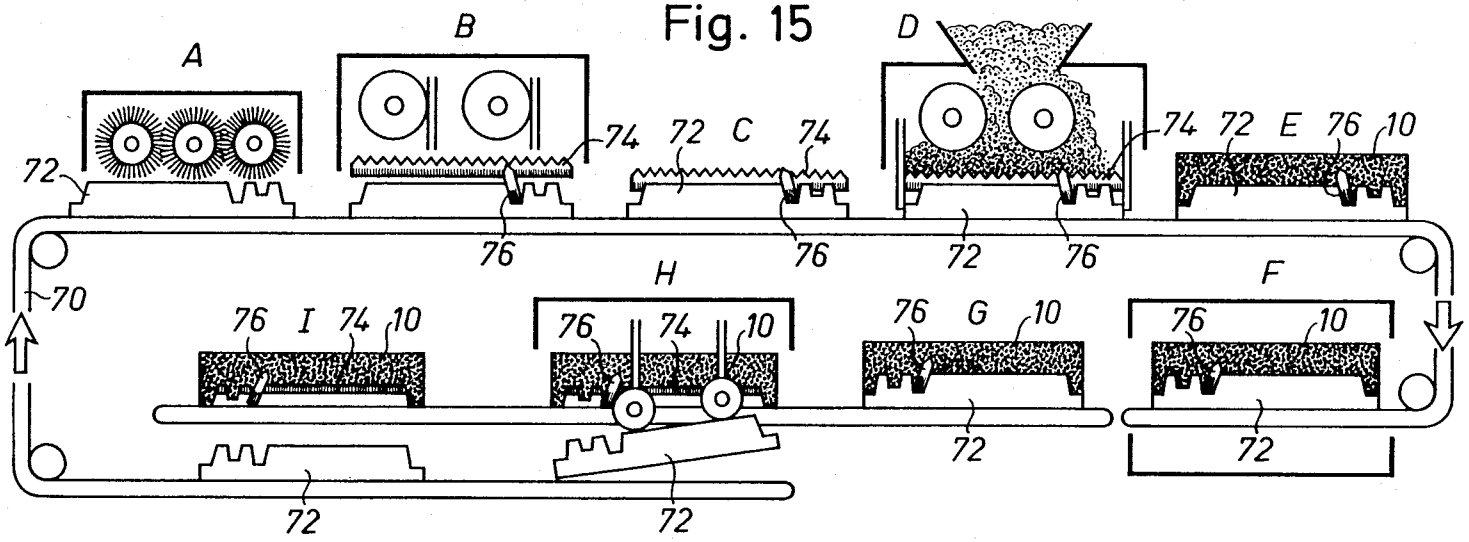
Figure 16:
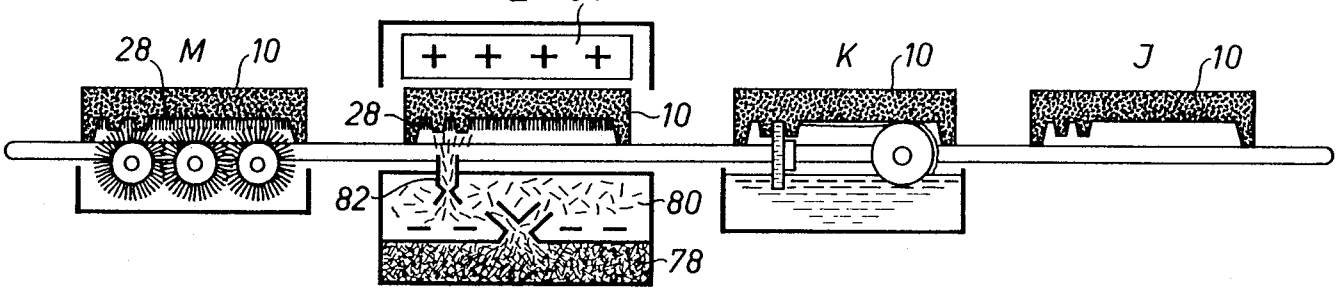

FIGS. 15 and 16 diagrammatically show plants for producing roofing plates corresponding to the above embodiments in accordance with the methods of the present invention.

The plant shown in FIG. 15 comprises a number of stations A–I through which a mould or form 72 is passed by means of continously operating conveyor means 70. In the first station A, the mould or form 72, which has a shape complementary to the desired roofing plate shape, is cleaned. In station B, proofing strips 74 and 76 are arranged in grooves in the mould or form 72. Station C serves to transport the mould or form with the proofing strips 74 and 76 arranged in it on to a station D in which the mould or form is filled with casting material, which may be e.g. concrete, clay or fibrous cement. From station D, the mould or form having proofing strips arranged in it and casting material arranged on it is passed via a station E to a station F in which the casting material is cured. From the station F, the roofing plate which is substantially finished, is passed via a station G to a station H, in which the mould or form 72 is separated from the finished roofing plate 10. In station I, the finished roofing plate 10 is passed to a store, while the mould or form 72 is returned to the station A, whereupon the above production process is repeated. It should be noted that the proofing strips 74 and 76 are cast into the roofing plate 10 in accordance with the method of producing roofing plates described above with reference to FIG. 15.

The plant shown in FIG. 16 differs from the plant shown in FIG. 15 in that the proofing strips of the roofing plate are not applied to or arranged on the roofing plate until after the latter has been produced and is substantially finished. From a station J, the roofing plate 10 is passed to a station K in which the areas of the upper side surface or the lower side surface of the roofing plate on which proofing strips are to be applied, are cleaned, and a binder in the form of an adhesive layer or glue layer is applied.

From the station K the roofing plate 10 is passed to a station L in which the proofing strips of the roofing plate 10 are applied. While the proofing strips 74 and 76 described above with reference to FIG. 15 may be of any of the above types, preferably, however, comprising a base layer corresponding to the embodiments shown in FIGS. 10 and 11, a strip of synthetic fibres constituting the proofing strip according to the invention is applied directly to the roofing plate or tile 10 in station L. The synthetic fibres are passed from a reservoir 78 to a charging chamber 80 in which the fibres are charged electrostatically to a negative polarity and from which the fibres may only escape through a nozzle 82. The roofing plate 10 is passed over the charging chamber 80 and the nozzle 82. As shown in FIG. 16, a positive pole plate 84 attracting the fibres electrostatically charged to negative polarity is arranged on the side of the roofing plate 10 opposite to the fiber reservoir 78 and the charging chamber 80. The electrostatic fibres leave the nozzle 82 at great speed and are retained in the adhesive layer or glue layer applied in station K. In a station M, the excess fibres are cleaned off. Alternatively, the synthetic fibres may be charged to a positive polarity, the pole plate 84 then being maintained at negative polarity.

Furthermore, apart from being operated at opposite polarity, the electrostatical application station L may be turned upside down so that the fibres are applied from a nozzle above the roofing plate or tile. Consequently, the roofing plate or tile has its side surface to be provided with the synthetic fibre proofing strips facing upwards instead of downwards as in the embodiment shown in FIG. 16. Furthermore, the station M serving the purpose of removing excess fibres may advantageously be modified into a suction station.

The plant shown in FIG. 16 may, in accordance with the invention, be modified by the roofing plate 10 shown in the station J being a cast by as yet unhardened roofing plate or tile of e.g. clay, concrete or fibrous cement. In this modified method of producing roofing plates, the synthetic fibres are retained directly in the surface of the still wet and unhardened roofing plate or tile 10. Consequently, the use of an adhesive layer or glue layer to be applied in the station K may be avoided.

Figure 17:
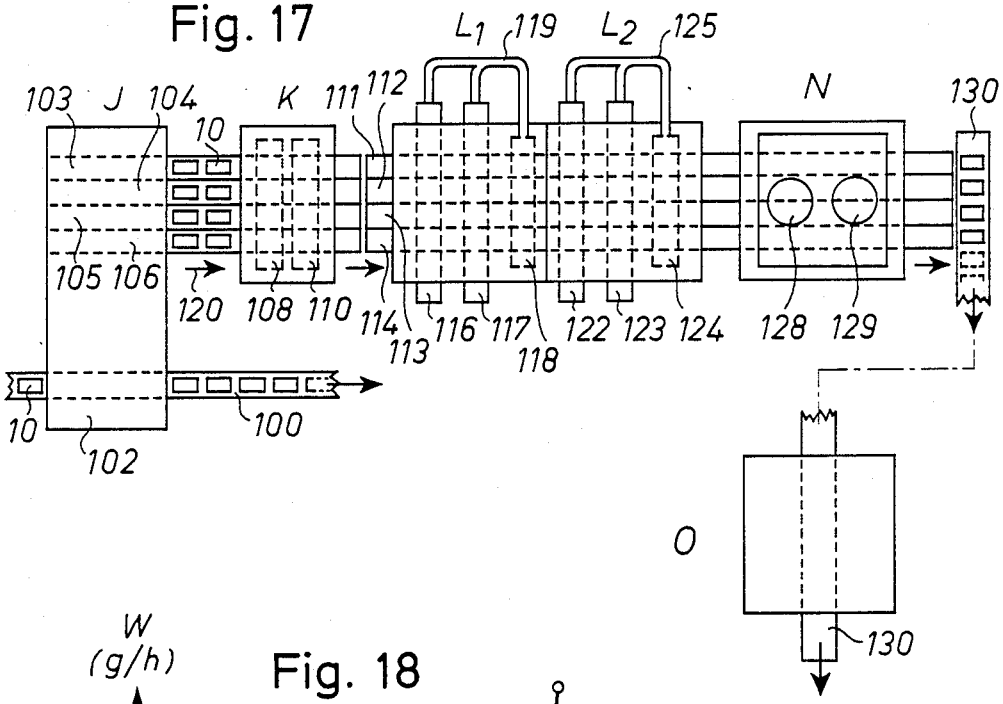

In FIG. 17, a schematical top view of a production plant for producing roofing plates or tiles according to the invention is shown. From production or casting stations in which precast or prefabricated roofing plates or tiles are provided, a conveyor 100 receives the roofing plates or tiles to be provided with proofing strips in accordance with the teaching of the present invention or to be transferred to a store as indicated by an arrow at the right hand end of the conveyor 100. The conveyor 100 cooperates with a transfer station 102 in which the roofing plates or tiles are transferred from the conveyor 100 to four parallel conveyors 103, 104, 105 and 106 and if necessary turned upside down so that the upper side surfaces of the roofing plates or tiles 10 to be applied with proofing strips are facing upwards. From the transfer station 102 which constitutes the station J shown in FIG. 16, the conveyors 103, 104, 105 and 106 make the roofing plates or tiles advance at a speed of approximately ten roofing plates or tiles per minute on each of the conveyors providing a total production speed or capacity of approximately fourty roofing plates or tiles per minute.

The roofing plates or tiles are advanced intermittantly by means of the conveyors 103–106 in a direction indicated by an arrow 120 and are transferred to the glue application station K in which two glue applicators 108 and 110 apply glue to the areas of the upper side surfaces of the roofing plates or tiles to have the proofing strips 27 and 29 and the proofing strip extension **29*a* shown in FIG. 1 arranged thereon while the roofing plates or tiles are intermittantly stopped below the glue applicators 108 and 110. The glue applicators 108 and 110** apply layers of water-based and acrylic basis glue and of a thickness corresponding to a glue consumption of 300–500 g/m$^2$.

From the discharge end of the glue application station K, the roofing plates or tiles 10 are transferred from the intermittantly operated conveyors 103, 104, 105 and 106 to continuously operated conveyors 111, 112, 113 and 114, respectively. The conveyors 111–114 are moving continuously at a speed of approximately 4–5 m/min. They serve the purpose of moving the preglued roofing plates or tiles to the synthetic fibre application station L and to a glue drying station N. The synthetic fibre application station L is divided into two substations designated L1 and L2, respectively. The substations L1 and L2 serve the purpose of applying synthetic fibres of a length of 3 mm and 5 mm, respectively, to the preglued roofing plates or tiles. The synthetic fibres are preferably of polyamide of the type 22 dtex and are pretreated for electrostatical application. In the fibre application stations L1 and L2, synthetic fibres are charged to a potential of approximately 50–100 kV of negative polarity relative to earth and the roofing plates or tiles are maintained at opposite, i.e. positive polarity. Each of the synthetic fibre application stations L1 and L2 comprise two parallel applicators 116, 117 and 122, 123, respectively, and a single excess fibre removing device 118 and 124, respectively, constituted by vacuum suction devices which are connected to the applicators 116, 117 and 122, 123, respectively, through return conduits 119 and 125, respectively.

From the synthetic fibre application stations L1 and L2, the roofing plates or tiles 10 having the synthetic fibres arranged standing upright from the outer side surfaces thereof and adhering in the glue layers are transferred to the glue drying station N comprising infrared radiators 128 and 129. In the IR drying station N the glue layers of the roofing plates or tiles are cured so that the synthetic fibres arranged standing upright therefrom are fastened to the roofing plates or tiles.

From the IR drying station N the finished roofing plates or tiles are transferred to a further conveyor 130 by means of which the finished roofing plates or tiles are transferred to the above mentioned store as indicated by an arrow at the lower end of the conveyor 130. Alternatively, the conveyor 130 may transfer the finished roofing plates or tiles to a packing station O shown in the lower right-hand side of FIG. 17.

EXAMPLE

A solid concrete tile of the configuration shown in FIG. 1 and measuring approximately 42 cm×33 cm along the corrugations and at right angles to the corrugations, respectively, was provided with proofing strips basically corresponding to the proofing strips 27 and 29 and the proofing strip extension 29*a* shown in FIG. 1. The width of the proofing strip extending across the corrugations at the uppermost end of the tile, i.e. the proofing strip corresponding to the proofing strip 27 shown in FIG. 1 was 25 mm. A two component polyurethane basis glue was applied manually to the upper side surface of the roofing plate or tile providing a layer of glue of a thickness of approximately 0.5 mm. The proofing strips were constituted by a combination of 3 mm and 5 mm, 22 dtex polyamide fibres which had been pretreated for electrostatic application (pretreated for Flock application). The polyamide fibres were applied to the upper side surface of the tile by means of a test laboratory Flock application apparatus, and thereafter, the glue was cured.

In order to investigate the barrier characteristics of the roofing plate according to the invention, a number of corrugated sidelock tiles of the above described type, i.e. of the type shown in FIG. 1 and described in the above example were tested by the New Technology and Product Development Centre of Redland Technology Ltd., Graylands, Horsham, Sussex, England, and compared to basically identical tiles without proofing strips according to the invention. The tiles with proofing strips and the tiles without proofing strips were tested in a comparison test in which very rough weather conditions were simulated. A test group set-up of each of the two kinds of tiles, i.e. the tiles with proofing strips and the tiles without proofing strips, includes a total of three courses each including three and a half tiles per course. The overlap of the tiles was 75 mm, and the tiles were not nailed to the supporting roof construction. The roof construction defined a pitch of 30° in relation to the horizon and exposed the outer side surface of the test group set-up to wind and rain generated by wind and rain generators. The wind speed was 13.4 m/s and the rain fall rate was 38 mm/h. A perspect box was arranged below the test group set-up. By reducing the pressure within the perspect box, i.e. at the lower side surface of the test group set-up, a kind of suction effect was produced resulting in an increase in the amount of water penetrating through the tile construction to the lower side surface thereof. During test, the lower side surface pressure was reduced in increments of 10 Pa and the amount of water penetrating through the tile construction during a 5 min. period was measured. The measuring results were converted into an amount per hour and a graph was plotted illustrating the amount of water penetrating through the tile construction as a function of the reduced pressure at the lower side surface of the test group set-up. For a more detailed explanation of the test conditions, the test set-up and the relevance of the test procedure, reference is made to report No. 3518-02 dated May 1984 from the above New Technology and Product Development Centre of Redland Technology Ltd.

Figure 18:
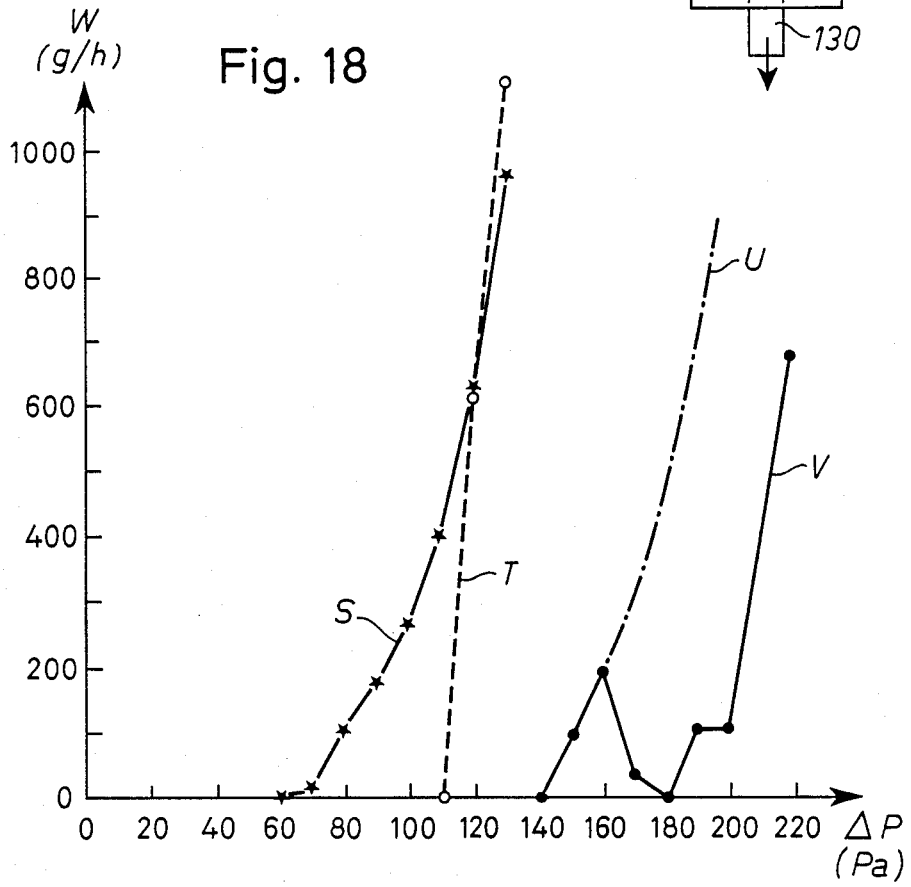

The graph of the measuring results are shown in FIG. 18. A first curve designated S illustrates the response obtained with regard to the tiles without proofing strips, and a second curve designated V illustrates the measuring results obtained with regard to the roofing plates according to the invention, i.e. the tiles with proofing strips. These measuring results were obtained at a rig pitch of 30°. By reudcing the rig pitch of the test group set-up of the tiles with proofing strips from 30° to 20° a further curve T was obtained. A fourth curve designated U is an extrapolation of the initial measuring results obtained with regard to the tiles with proofing strips and is a compensation of the discontinuity of the V curve. This discontinuity is believed to be caused by a "slug" effect, i.e. the water penetrating to the lower side surface of the tiles is not dripping but creaping down the lower side surface of the tiles, and is consequently not measured.

In a further test, the amount of water penetrating to the lower side surfaces of the tiles during one hour was recorded, at a non-reduced pressure at the lower side surface of the test group set-up.

By comparing the curves S and V or U, it is evident that the provision of the proofing strips at these extreme rough weather conditions results in a highly improved proofing of the roof.

Although the invention has been described with reference to the drawing illustrating a number of embodiments of the invention, the invention is not limited to these embodiments. Thus the principles of the invention may also be used in connection with roofing plates which are not corrugated, e.g. plates of metal, plastics or a similar material, and at the same time the synthetic fibres of the proofing strip may advantageously, as mentioned above, form a maze pattern to further increase the barrier forming effect.

I claim:

1. A corrugated interlocking tile roofing plate having opposite side surfaces and comprising proofing strip means on at least one of said surfaces and extending thereacross, for providing a substantially water impervious barrier while generally providing an air and humidity permiable passageway, said plate being adapted to be arranged on a roof partly overlapping and partly being overlapped by adjacent roofing plates, said roof defining an attic thereunder, and said proofing strip means including a strip of upright synthetic fibres located on said plate on regions thereof which are overlapped by adjacent plates, to provide a fibrous barrier between said side surface of said roofing plate and the opposite side surface of one of said adjacent roofing plates which permits the passage of air in and out of said attic and further permits the passage of humidity to escape to outside said loft but substantially blocks the passage of water and dust from the outside from coming into said attic when said strip of upright synthetic fibres is situated in abutment with said adjacent plate.

2. A roofing plate according to claim 1, said synthetic fibres having a free length of about 1–30 mm and a thickness of about 0.01–0.5 mm.

3. A roofing plate according to claim 2, said synthetic fibres having a free length of about 2–15 mm.

4. A roofing plate according to claim 3, said synthetic fibres having a free length of about 3–8 mm.

5. A roofing plate according to claim 2, said synthetic fibres having a thickness of about 0.05 mm.

6. A roofing plate according to claim 1, said synthetic fibres forming a maze pattern.

7. A roofing plate according to claim 1, said plate being of a substantially rectangular configuration having pairs of opposite edges constituting vertical and horizontal edges of said plate when said plate is arranged on said roof, and said proofing strip extending along one of said horizontal edges of said plate.

8. A roofing plate according to claim 7, said proofing strip being arranged on said side surface of said plate constituting the upper side surface when said plate is arranged on said roof.

9. A roofing plate according to claim 8, a further proofing strip being arranged extending along one of said vertical edges of said plate.

10. A roofing plate according to claim 7, said proofing strip being arranged on said side surface of said plate constituting the lower side surface when said plate is arranged on said roof.

11. A roofing plate according to claim 10, a further proofing strip being arranged extending along one of said vertical edges of said plate.

12. A roofing plate according to claim 1, including a first proofing strip being arranged on an upper side surface of said plate at its uppermost horizontal edge thereof, and a second proofing strip being arranged on a lower side surface of said plate at its lowermost horizontal edge thereof.

13. A proofing strip for use in connection with a corrugated interlocking tile roofing plate having opposite side surfaces and being adapted to be arranged on a roof partly overlapping and partly being overlapped by adjacent roofing plates, said roof defining an attic thereunder, and said proofing strip comprising means for substantially blocking passage of water while permitting passage of air and humidity, said means including a base layer and a strip of synthetic fibres located on said plate in a region which is overlapped by adjacent plates, said fibres standing upright from said base layer to provide a barrier which permits the passage of air in and out of said attic and further permits the passage of humildity from the inside to escape said attic but substantially blocks the passage of water and dust from the outside from coming into the attic when said proofing strip is clamped between said opposite said surfaces of adjacent roofing plates.

14. A proofing strip according to claim 13, said synthetic fibres having a free length of about 1–30 mm and a thickness of about 0.01–0.5 mm.

15. A proofing strip according to claim 14, said synthetic fibres having a free length of about 2–15 mm.

16. A proofing strip according to claim 15, said synthetic fibres having a free length of about 3–8 mm.

17. A proofing strip according to claim 14, said synthetic fibres having a thickness of about 0.05 mm.

18. A proofing strip according to claim 13, said synthetic fibres forming a maze pattern.

* * * * *